US006530678B1

(12) United States Patent
Kirsten

(10) Patent No.: US 6,530,678 B1
(45) Date of Patent: Mar. 11, 2003

(54) LIGHTNING UNIT

(75) Inventor: Martin Kirsten, Burscheid (DE)

(73) Assignee: Heidi Anette Bahren (DE)

( * ) Notice: Subject to any disclaimer, the term of this patent is extended or adjusted under 35 U.S.C. 154(b) by 0 days.

(21) Appl. No.: 09/713,007

(22) Filed: Nov. 16, 2000

(30) Foreign Application Priority Data

Jan. 28, 2000 (DE) ..... 00101737

(51) Int. Cl.[7] ..... F21V 9/00

(52) U.S. Cl. ..... 362/293; 362/16; 362/296; 362/343

(58) Field of Search ..... 362/293, 263, 362/296, 166, 301, 3, 18, 16, 17, 343; 359/887, 890

(56) References Cited

U.S. PATENT DOCUMENTS 4,517,491 A * 5/1985 Otto et al. ..... 313/111
4,814,956 A * 3/1989 Kano ..... 362/293
5,285,362 A * 2/1994 Sakata ..... 362/263

FOREIGN PATENT DOCUMENTS

DE 3515879 12/1986
DE 29720592 7/1999

OTHER PUBLICATIONS

Patent Abstracts of Japan, Publication No. 03246806, Appl. Date Feb. 23, 1990.

* cited by examiner

*Primary Examiner*—Sandra O'Shea
*Assistant Examiner*—John Anthony Ward
(74) *Attorney, Agent, or Firm*—Liniak, Berenato & White, LLC

(57) ABSTRACT

The invention describes a lighting unit having a light source and having a wavelength-dependent filter device with a selectively transmissive filter and/or a selectively reflective mirror reflector in order, for the purpose of emphasizing the body color of an object to be illuminated, to filter out color components of the light coming from the lamp whose color locus on the chromaticity diagram is located opposite the color locus of the body color that is to be emphasized on a connecting line passing through the achromatic point (complementary color), which is characterized in that the filter device additionally filters out a portion of the color component of the same body color that is to be emphasized.

14 Claims, 2 Drawing Sheets

LIGHTNING UNIT

The present invention concerns a lighting unit having a light source and having a wavelength-dependent filter device with a selectively transmissive filter and/or a selectively reflective mirror reflector in order, for the purpose of emphasizing the body color of an object to be illuminated, to filter out color components of the light coming from the lamp whose color locus on the chromaticity diagram is located opposite the color locus of the body color that is to be emphasized on a connecting line passing through the achromatic point (complementary color).

A lighting unit of this kind is known from DE 35 158 879 C1. This lighting unit possesses a filter device in order, for the purpose of emphasizing the "warm" body colors orange, red, and purple, to filter out the corresponding complementary colors in the spectral region from 480 to 570 nm. Filtration in this relatively narrow spectral region results in filter transmission curves with steep filter edges. In addition, not only is the body color that is to be emphasized indeed emphasized, but the color of the light itself is also greatly modified, so that an optionally white surrounding area is undesirably given a reddish tint.

The narrow-band filters that are used are usually manufactured as interference filters, and their function requires a plurality of interference layers. While the use of such filters in lighting units whose lamps radiate a continuous light spectrum, for example halogen lamps, is relatively unproblematic, the use of a filtration arrangement of this kind is problematic when the lamps used are ones that generate a line spectrum. Especially when using a high-pressure sodium vapor lamp with improved color reproduction, whose light spectrum is intended to emphasize red by way of a filter arrangement of this kind, the transmission minimum of the filter curve coincides with a steep edge in the light spectrum of this lamp, so that tolerances in filter manufacture, which are un-avoidable, have a very pronounced effect.

A further problem is the fact that the effect of such interference filters depends to a great degree on the angle of the incoming light.

It is therefore the object of the present invention to configure a lighting unit of the kind cited initially in such a way that the desired emphasis of a body color is associated with only minor modification of the light color, and the filter effect is insensitive to production tolerances both of the lamps used and of the filter device. The intention in particular is to make possible, without difficulty, the use of lamps that radiate a line spectrum, and to decrease the angular dependence of the filter device.

According to the present invention, this object is achieved in that the filter device additionally filters out a portion of the color component of the same body color that is to be emphasized.

The invention is thus based on the idea of filtering out not only the colors complementary to a body color that is to be emphasized, but also a portion of the same body color that is to be emphasized. If the body color red is to be emphasized, for example, the color components of the complementary colors are filtered out in conventional fashion, and according to the present invention reddish color components in the region from 660 to 780 nm are additionally filtered out as well. The result of filtering out these reddish color components is that the light color is influenced in such a way that a white surrounding area has less of a reddish tint or none at all, i.e. the white background remains substantially white. The fact that these color components are filtered out has almost no influence on the emphasis of the body color, since these spectral components that are additionally filtered out are located in that region of the photopic response curve of the human eye in which the eye possesses little sensitivity, so that absorption or reflection losses in terms of light attenuation by the filter device are imperceptible.

When lamps with a continuous light spectrum are used, the color components having wavelengths substantially between 480 nm and 570 nm can be filtered out, in known fashion, in order to emphasize "warm" body colors. When a lamp with a highly inhomogeneous line spectrum, for example a high-pressure sodium vapor lamp, is to be used, then according to the present invention a filter device with a comparatively less narrow-band reflection or absorption characteristic is selected, for example a filter that is effective in the wavelength region from 500 nm to 620 nm. In addition, the filter device can be selected so that the absorption or reflection in the wavelength region from 480 to 620 nm is a maximum of 70%. The result of these actions is that the filter transmission curve has less-steep filter edges and shallower troughs, so that filter manufacturing tolerances have less of an effect.

Concerning further advantages and embodiments of the invention, reference is made to the dependent claims and to the description below of an exemplary embodiment referring to the appended drawings, in which:

Figure 1:
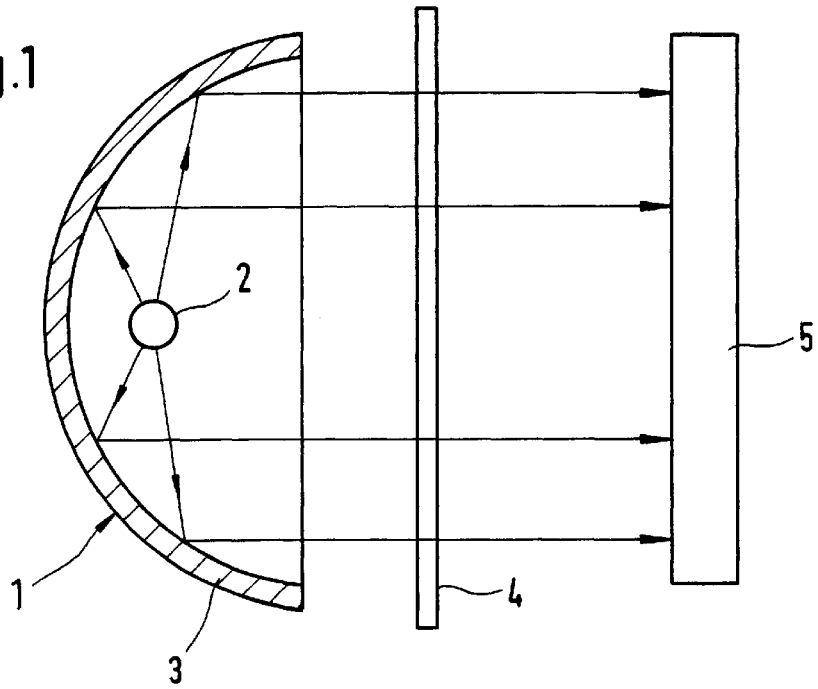
FIG. 1 shows a schematic depiction of a lighting unit having a lamp, a mirror reflector, and a filter.

Lighting unit 1 depicted schematically in FIG. 1 comprises a lamp 2, a mirror reflector 3, and a filter 4 at the output of mirror reflector 3. Located at a distance from filter 4 is an object 5 having a specific body color that is to be illuminated. The light source can be an incandescent lamp or a high-pressure gas discharge lamp with color reproduction better than grade 3 per DIN 5035, for example a high-pressure sodium vapor lamp with improved color reproduction, or a metal halide vapor lamp. The filter can be manufactured by vacuum-coating clear glass with interference layers. For one skilled in the art, it is not a problem to configure the interference layers in such a way that only specific color components are absorbed or reflected, while the others are allowed to pass.

The surface of mirror reflector 3 can be made of aluminum or silver, or can also be configured as a cold light reflector coating. The latter acts selectively, i.e. it reflects only light rays in the visible region, while allowing thermal radiation in the infrared region to pass through.

As an alternative to the exemplary embodiment shown in FIG. 1, the lighting unit can also be configured such that the color components are held back not by absorption or reflection with the aid of an additionally arranged filter, but by a particular configuration of the mirror reflector. Specifically, a selective reflection of color components at the mirror reflector can be attained by way of corresponding interference layers, in such a way that certain wavelength regions are reflected whereas other color components are allowed to pass through the mirror reflector. This can be achieved with ordinary materials and manufacturing methods. Also conceivable is a combination of the two features, i.e. the filter and the selectively reflective mirror reflector.

Figure 2:
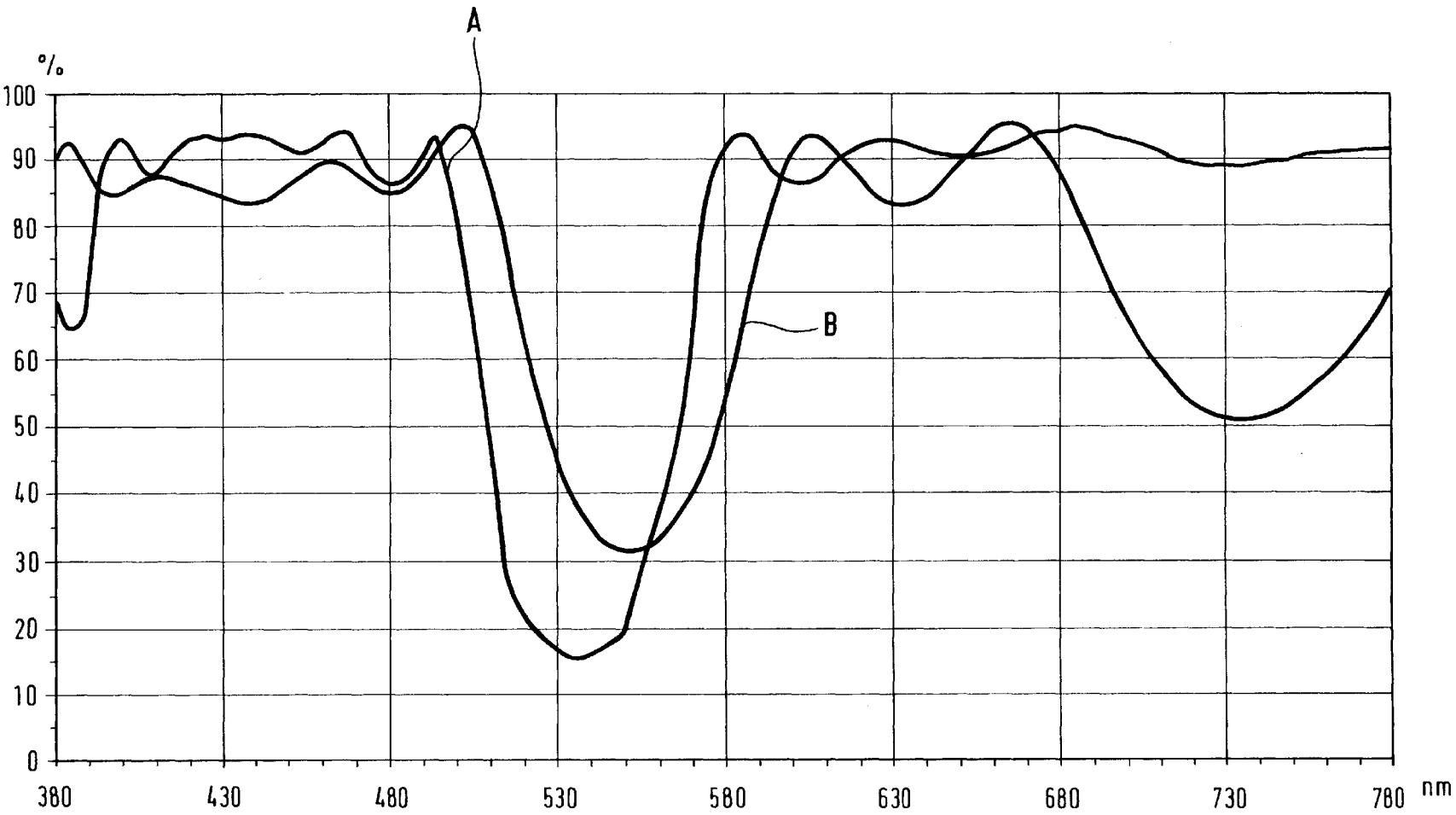
FIG. 2 shows a graph depicting transmittance for the lighting unit shown in FIG. 1, tuned for "warm" colors.

FIG. 2 shows the transmittance properties of the lighting unit shown in FIG. 1 with two different filters, namely a conventional filter used hitherto as defined in DE 35 15 879 C1 (curve A), and a filter according to the present invention (curve B). In each case, transmittance is plotted on the ordinate (as a percentage) as the reciprocal of the absorption or reflection, while the abscissa provides values for the wavelength of the color components, from violet (380 nm) through blue (450 nm), green (520 nm), and yellow (580 nm) to deep red (780 nm).

With the conventional filter represented by curve A, the unavoidable total residual absorption or residual reflection is approximately 25% for all color components, i.e. total transmittance is 75%. By way of corresponding coating or pigmentation, transmittance in a specific region—namely between 500 and 580 nm—is decreased to 15%, i.e. up to 85% of the color components between 500 and 580 nm are held back. As a result, the "cold" colors blue and green are partially filtered out, resulting in saturation and thus emphasis of the "warm" colors as body colors. As curve A shows, transmittance curve A of the conventional filter possesses very steep sides and a deep trough. When a high-pressure sodium vapor lamp with improved color reproduction is used, with the intention of using its light spectrum to emphasize red by way of a filter arrangement of this kind, the transmittance minimum of filter curve A coincides with a steep edge in the light spectrum of this lamp, so that unavoidable tolerances in filter manufacture have a very pronounced effect. In addition, not only is the body color that is to be emphasized indeed emphasized, but the color of the light itself is changed, with the result that reddish tinting of a white background can occur.

With the filter according to the present invention having transmittance curve B, the unavoidable total residual absorption or residual reflection is once again 25% for all color components, i.e. total transmittance is 75%. The filter device is configured, however, in such a way that it possesses a less narrow-band reflection or absorption characteristic, which moreover acts to a lesser degree; in other words, transmittance is decreased over a wider region—namely between approximately 500 nm and 620 nm—to approximately 32%, i.e. only up to 68% of the color components between 520 and 620 are held back. As a result—as is clearly evident from the depiction—the transitions in the high-transmittance and lowest-transmittance regions are softened, so that the difference between a light filtered in this fashion and an unfiltered light is not perceptible on a white object.

In addition, color components in the region from 660 to 780 nm are filtered out by a filter according to the present invention; here the transmittance is decreased to only about 50%, i.e. only up to 50% of the color components in the red light region between 660 and 780 nm are held back. As a result of this decrease in the red components, the light color is influenced in such a way that it appears almost unchanged on a white background. Since these spectral components are located in the region of the human eye's photopic response curve where the eye has little sensitivity, the absorption or reflection loss results in only negligible light attenuation by the filter device, so that the emphasis on the red body color is almost unchanged. In addition, thermal radiation is reduced by the filtration in the near infrared region.

Figure 3:
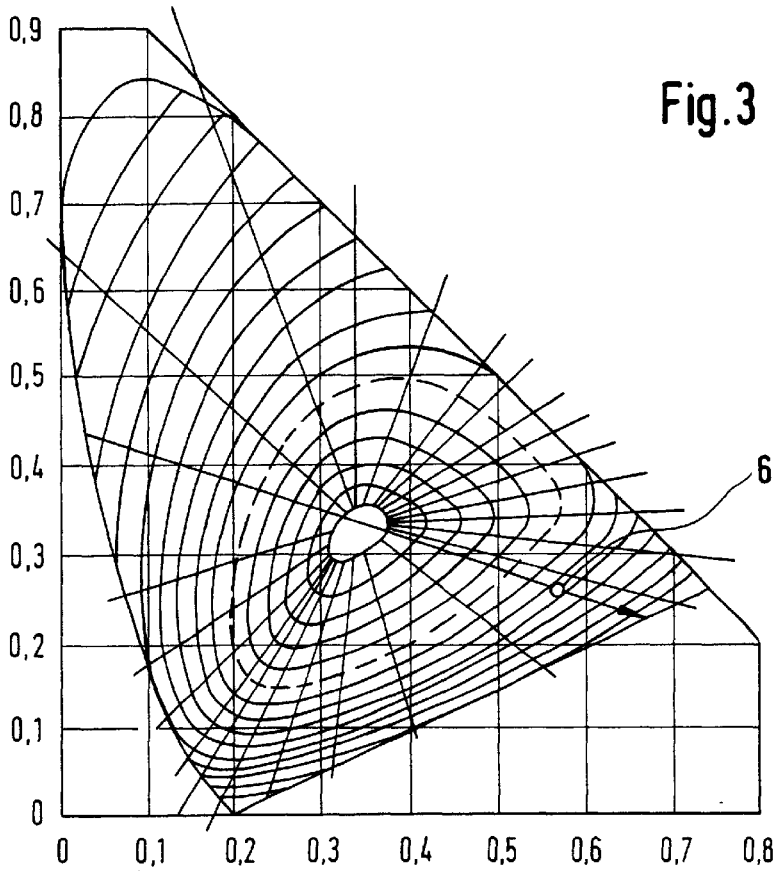
FIG. 3 shows the chromaticity diagram per DIN 5033, in a black-and-white version.

FIG. 3 shows, purely for information, the chromaticity diagram per DIN 5033 in a black-and-white depiction. The values x and y on the abscissa and ordinate, respectively, indicate chromaticity coordinates. These coordinates thus define the color locus of a particular chromaticity. Located in the central area is point C, called the achromatic point. The boundary curve is composed of the spectral colors and the so-called purple line. Several wavelengths (in nanometers) are indicated along the spectral color line. All other chromaticities are located between achromatic point C and the boundary curve. The radii proceeding from achromatic point C each contain colors of identical chromaticity at increasing saturation, and are labeled 1 through 24. The chromaticity of an additive color mixture of two components is always located in the color diagram on the straight line connecting the chromaticities of the components. The oval lines surrounding achromatic point C indicate chromaticities of identical saturation S.

By way of example, the chromaticity 6 of a body color is indicated in the lower right corner of the chromaticity diagram. It lies in the purple region, i.e. in the "warm" color region. As with all normally manufactured dyes, saturation is incomplete. If a correspondingly configured filter 4 is then used to filter out the color components located opposite color locus 6 on the other side of achromatic point C, with wavelengths of about 495 nm, the degree of saturation is increased in such a way that color locus 6 migrates outward, in the direction of the arrow, toward the boundary of the spectral color curve. Because of the resulting increase in degree of saturation, the body color is correspondingly emphasized with no falsification of any other body colors.

What is claimed is:

1. A lighting unit having a light source and having a wavelength-dependent filter device (3, 4) with at least one of a selectively transmissive filter (4) and a selectively reflective mirror reflector (3) in order, for the purpose of emphasizing the body color of an object to be illuminated, to filter out color components of the visible light coming from the lamp (1) whose color locus on the chromaticity diagram is located opposite the color locus of the body color that is to be emphasized on a connecting line passing through the achromatic point (C) (complementary color), characterized in that the filter device (3, 4) additionally filters out a portion of the color component of the same body color that is to be emphasized.

2. The lighting unit as defined in claim 1, characterized in that in order to emphasize "warm" body colors (orange, red, purple), color components in the wavelength is region between 480 and 620 nm, and in the wavelength region from 660 to 780 nm, are simultaneously filtered out.

3. The lighting unit as defined in claim 2, characterized in that the absorption or reflection of the filter device (3, 4) in the wavelength region from 480 to 620 nm is a maximum of 70%, and the absorption or reflection in the wavelength region from 660 to 780 nm is a maximum of 50%.

4. The lighting unit as defined in claim 1, characterized in that the lamp (1) is a gas discharge lamp, in particular a high-pressure sodium vapor lamp with improved color reproduction.

5. The lighting unit as defined in claim 1, characterized in that the selectively transmissive filter (4) is configured as an interference filter.

6. A method of illuminating an object having a body color to emphasize the body color comprising the steps of:

providing a light source for emitting light having color components;

placing an object in the path of the light emitted from said light source;

filtering from said emitted light a first portion of the color components of visible light complementary to said body color; and filtering from said emitted light a second portion of the color components of visible light emphasizing said body color.

7. The method of claim 6 wherein said second portion is less than said first portion.

8. The method of claim 6 wherein the step of filtering from said emitted light color components complementary to said body color comprises the step of filtering from said emitted light no more than about 70 per cent of color components having wavelengths complementary to said body color.

9. The method of claim 8 wherein the step of filtering from said emitted light a portion of the color components of said body color comprises the step of filtering from said emitted light no more than about 50 percent of the color components of said body color.

10. A lighting unit for illuminating a body having a color to emphasize said color comprising:

a light source; and a wavelength-dependent filter for filtering out a first portion of color components of visible light complementary to the color of the body and filtering out a second portion of the color components of visible light emphasizing the body color.

11. The lighting unit of claim 10 wherein said color components complimentary to the color of the body comprise color components having wavelengths between 480 nm and 620 nm.

12. The lighting unit of claim 10 wherein said body color has a wavelength of between about 660 nm and 780 nm.

13. The lighting unit of claim 10 wherein said first portion is less than about 70 percent.

14. The lighting unit of claim 10 wherein said second portion is less than about 50 percent.

* * * * *